US010271128B2

(12) United States Patent
Li

(10) Patent No.: US 10,271,128 B2
(45) Date of Patent: Apr. 23, 2019

(54) SPEAKER

(71) Applicant: Steve Li, Shenzhen (CN)

(72) Inventor: Steve Li, Shenzhen (CN)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 317 days.

(21) Appl. No.: 14/770,948

(22) PCT Filed: Mar. 1, 2013

(86) PCT No.: PCT/CN2013/072050
§ 371 (c)(1),
(2) Date: Aug. 27, 2015

(87) PCT Pub. No.: WO2014/131192
PCT Pub. Date: Sep. 4, 2014

(65) Prior Publication Data
US 2016/0014502 A1 Jan. 14, 2016

(51) Int. Cl.
*H04R 1/00* (2006.01)
*H04R 1/28* (2006.01)
*H04R 1/02* (2006.01)

(52) U.S. Cl.
CPC ..... *H04R 1/2819* (2013.01); *H04R 1/026* (2013.01); *H04R 1/2826* (2013.01)

(58) Field of Classification Search
CPC ..... H04R 1/2826
See application file for complete search history.

(56) References Cited

U.S. PATENT DOCUMENTS 5,576,522 A 11/1996 Taso
2007/0189566 A1 8/2007 Yamagishi et al.

FOREIGN PATENT DOCUMENTS

JP H0472899 A 3/1992
JP 2005051605 A 2/2005
JP 2005311986 A 11/2005
JP 2006229815 A 8/2006

OTHER PUBLICATIONS

International Search Report and Written Opinion for corresponding Application No. PCT/CN2013/072050, dated Dec. 5, 2013, 12 pages.
Extended European Search Report for corresponding Application No. 13876115.0, dated Aug. 10, 2016, 7 pages.

*Primary Examiner* — Matthew A Eason
(74) *Attorney, Agent, or Firm* — Brooks Kushman P.C.

(57) ABSTRACT

A speaker is provided. The speaker may include a speaker box which defines an inner chamber, and a bass tube extending outward from the inner chamber, where an external part of the bass tube which is outside the speaker box forms a supporting structure of the speaker. The speaker may have improved acoustic performance and a more compact structure.

11 Claims, 5 Drawing Sheets

SPEAKER

CROSS-REFERENCE TO RELATED APPLICATION

This application is the U.S. national phase of PCT Application No. PCT/CN2013/072050 filed on 1 Mar. 2013, the disclosure of which is incorporated in its entirety by reference herein.

TECHNICAL FIELD

The present disclosure generally relates to a speaker, and more particularly, to a speaker having a bass tube.

BACKGROUND

Bass performance is important to an acoustic system. Most speakers employ a vented bass-reflect design to improve sound efficiency at low frequency. FIG. 1 schematically illustrates a cross-sectional view of a conventional vented bass-reflect speaker 100. The speaker 100 may include a speaker box 101, a speaker driver 103 disposed on a sidewall of the speaker box 101, and a bass tube (also called "bass port") 105 disposed inside the speaker box 101. The bass tube 105 is open at both ends. Therefore, rear bass radiation may be reflected inside the speaker box 101 and educed through the bass tube 105, which may enhance the bass performance. However, the bass tube 105 may occupy some inner space of the speaker box 101, which reduces the acoustic volume and thus limits the bass reproduction range. Therefore, there is need for a speaker with improved acoustic performance.

SUMMARY

According to one embodiment of the present disclosure, a speaker is provided. The speaker may include a speaker box which defines an inner chamber, and a bass tube extending outward from the inner chamber, where an external part of the bass tube which is outside the speaker box forms a supporting structure of the speaker.

Compared with conventional speakers, the bass tube of the speaker of the present application occupies less volume of the inner chamber, and thus the acoustic performance of the speaker may be enhanced. Meanwhile, the external part of the bass tube forms a supporting structure, and this makes the speaker more compact.

In some embodiments, the supporting structure may be a speaker stand for supporting the speaker on a surface such as a floor, a desk, or the like.

In some embodiments, the external part may be disposed under the speaker box. In some embodiments, the external part may extend downward from the speaker box.

In some embodiments, the supporting structure may be a handle.

In some embodiments, the handle may extend from the speaker box such that the speaker can be lifted with only one hand grabbing the handle.

In some embodiments, the handle may extend along a substantially horizontal direction, and may be vertically projected onto the speaker box.

In some embodiments, a vertical axis going through a barycentre of the speaker substantially goes through the handle.

In some embodiments, the handle may have a shape like a hook.

In some embodiments, the bass tube may be partly disposed outside the speaker box, for example, more than 50% of a length of the bass tube may be disposed outside the speaker box.

In some embodiments, the bass tube may be completely disposed outside the speaker box.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1:
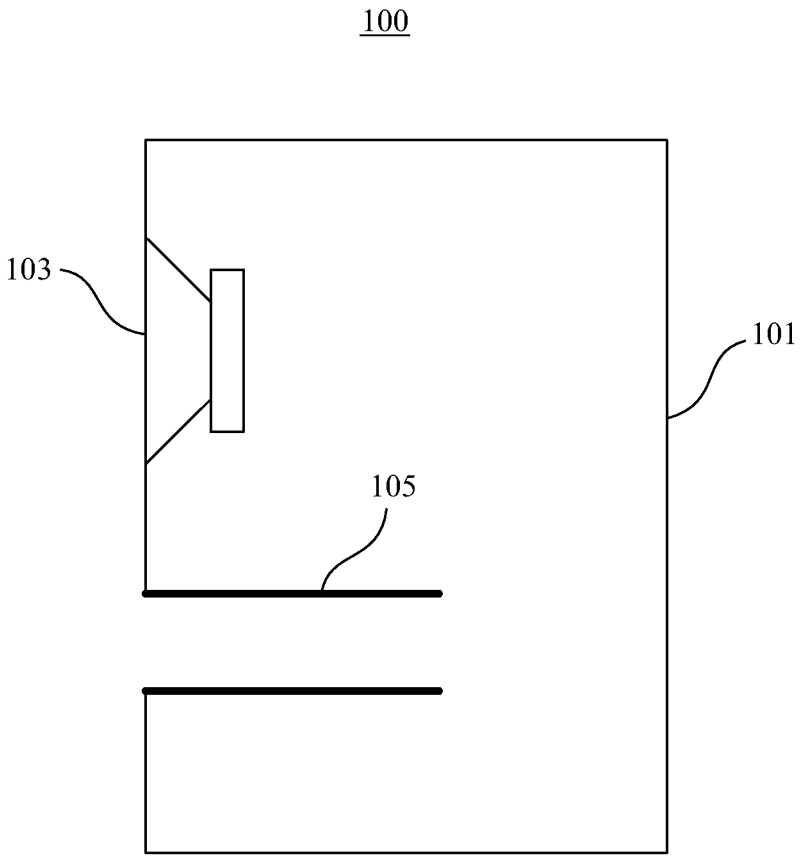
FIG. 1 schematically illustrates a cross-sectional view of a conventional vented bass-reflect speaker 100.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

Figure 2:
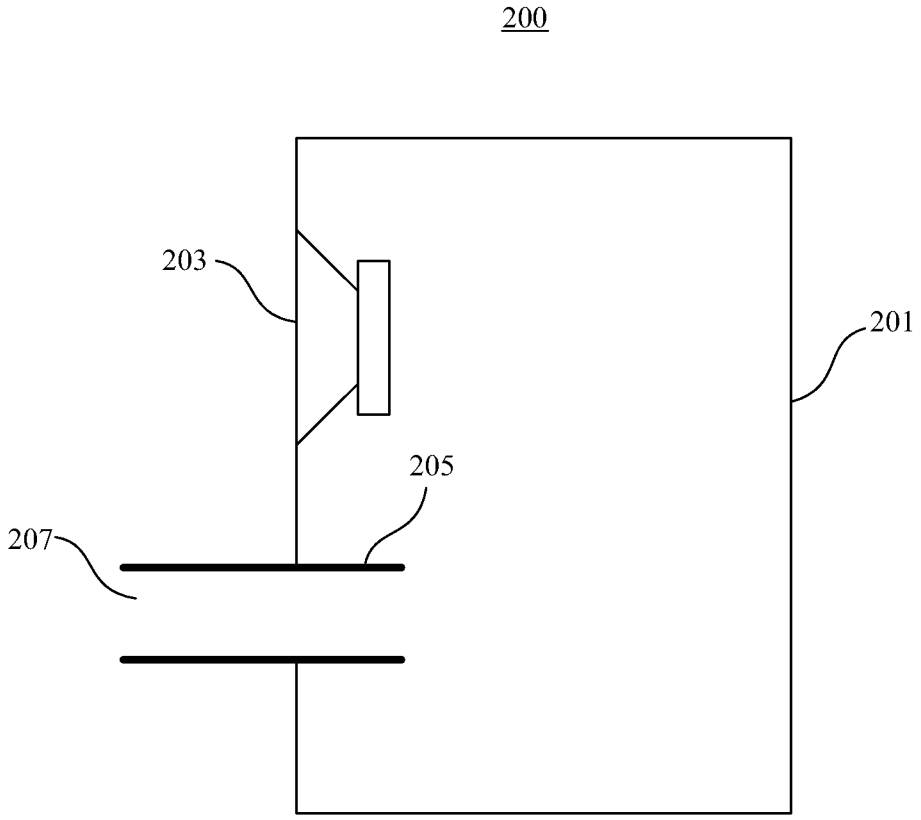
FIG. 2 schematically illustrates a cross-sectional view of a speaker 200 according to one embodiment of the present disclosure.

FIG. 2 schematically illustrates a cross-sectional view of a speaker 200 according to one embodiment of the present disclosure.

The speaker 200 may include a speaker box 201, a speaker driver 203 and a bass tube 205.

The speaker box 201 defines an inner chamber having a certain volume which is essential to a bass reproduction range of the speaker 200. Therefore, the volume of the inner chamber is also called "acoustic volume"

The speaker driver 203 disposed on the speaker box 201 may be a kind of transducer that converts electrical energy to sound waves. Sound waves produced by the speaker driver 203 may transmit toward all directions. A part of the sound waves, transmitting backward inside the speaker box 201, normally called "rear radiation", may be reflected by walls of the speaker box 201.

The bass tube 205 has a cross section which may be round, oval, rectangular or irregular. The bass tube 205 extends outward from the inner chamber of the speaker box 201 to guide the rear radiation out. The rear radiation may be educed through an opening 207 disposed at an external end of the bass tube 205. Therefore, the rear radiation may resonate with other parts of the sound waves, thereby enhancing the bass performance. In some embodiments, the opening 207 may be disposed at another position of the bass tube 205.

The bass tube 205 includes an external part which is outside the speaker box 201. Therefore, less volume of the inner chamber may be occupied by the bass tube. Since the bass reproduction range is very dependent on the acoustic volume of the inner chamber, the bass reproduction range may be increased, which thereby improves the acoustic performance of the speaker 200. Besides, the overall size of the speaker 200 may be reduced, or otherwise the speaker box needs to be enlarged to ensure the acoustic performance.

In some embodiments, the bass tube 205 may be partly disposed outside the speaker box 201, for example, more than 50% of a length of the bass tube 205 may be disposed outside the speaker box 201. In some embodiments, the bass tube 205 may be completely disposed outside the speaker box 201.

It should be noted that FIG. 2 is merely for illustration. Arrangement of the speaker driver 203 and the bass tube 205 shown in FIG. 2 is not intending to limit the scope of the present disclosure. For example, in some embodiments, the speaker may be provided with more than one speaker driver and/or more than one bass tube. In some embodiments, the speaker driver and the bass tube may be disposed on a same wall of the speaker box. In some embodiments, the speaker driver and the bass tube may be disposed on different walls of the speaker box.

Furthermore, the external part of the bass tube may function as other components. Therefore, the overall size of the speaker may be further reduced, thereby saving manufacturing costs. Hereunder, some examples will be given to illustrate a bass tube forming a supporting structure of a speaker box.

Figure 3:
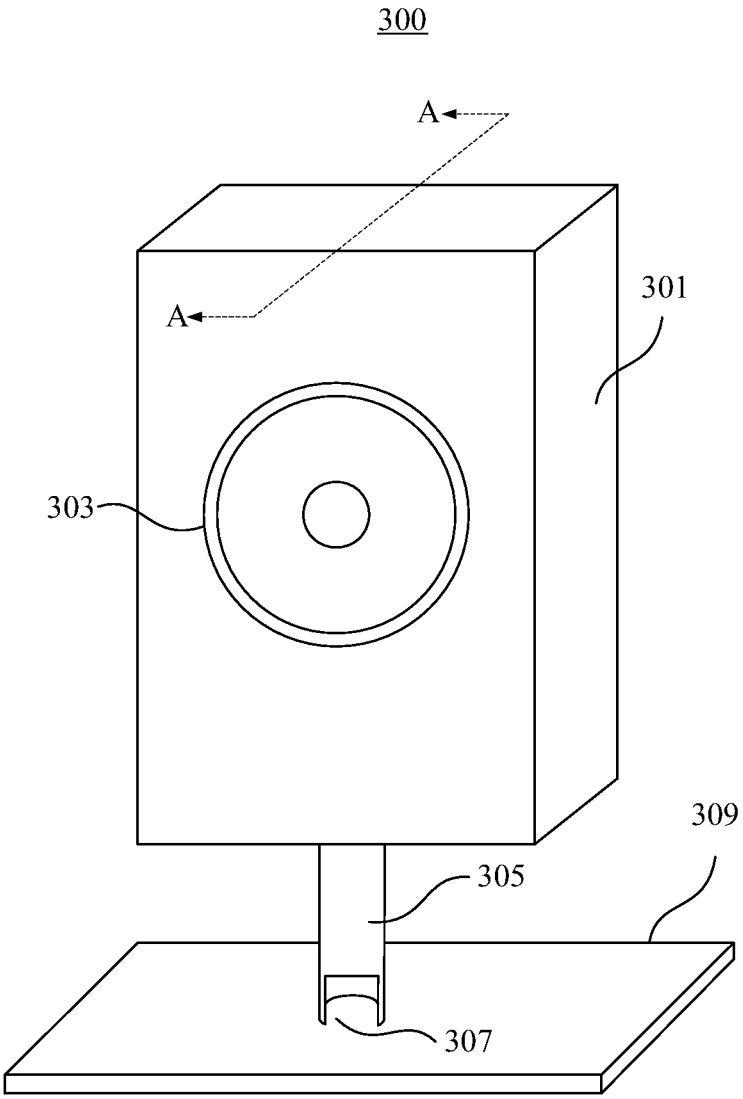
FIG. 3 schematically illustrates a three-dimensional view of a speaker 300 according to one embodiment of the present disclosure.
Figure 4:
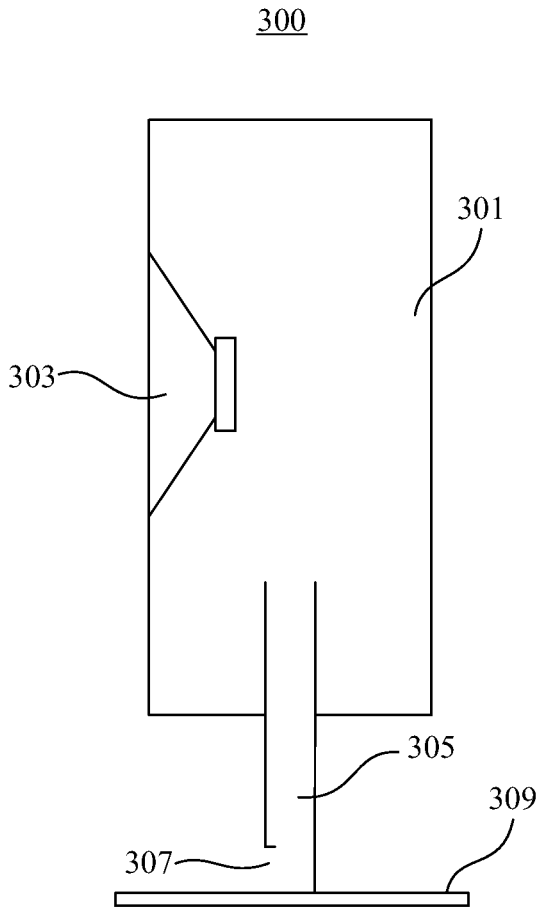
FIG. 4 schematically illustrates a cross-sectional view of the speaker 300 along AA direction shown in FIG. 3.

FIG. 3 schematically illustrates a three-dimensional view of a speaker 300 according to one embodiment of the present disclosure. FIG. 4 schematically illustrates a cross-sectional view of the speaker 300 along AA direction shown in FIG. 3. As shown in FIGS. 3 and 4, the speaker 300 may include a speaker box 301, a speaker driver 303 and a bass tube 305. To obtain detail arrangement of the speaker driver and the bass tube, please refer to above descriptions about the speaker 200.

The external part of the bass tube 305 forms a speaker stand. Therefore, the speaker box 301 may be supported by the external part above a floor, a desk, or the like.

Specifically, the external part may be disposed under the speaker box 301 and extend downward. As shown in FIGS. 3 and 4, in some embodiments, the external part may be straight and vertical. However, in some embodiments, the external part may have other shapes, for example, fastigiated, curved, or the like, as long as it can support the speaker box.

The external part of the bass tube 305 has an opening 307 for allowing sound waves in the speaker box 301 out. In some embodiments, the opening 307 may be disposed at an external end of the bass tube 305. In some embodiments, the opening 307 may be disposed at other positions, for example, middle of the external part.

Further, in some embodiments, the external part may stand on a plate 309 to keep the speaker 300 balanced. Therefore, the speaker 300 may stand on the external part more stably.

Figure 5:
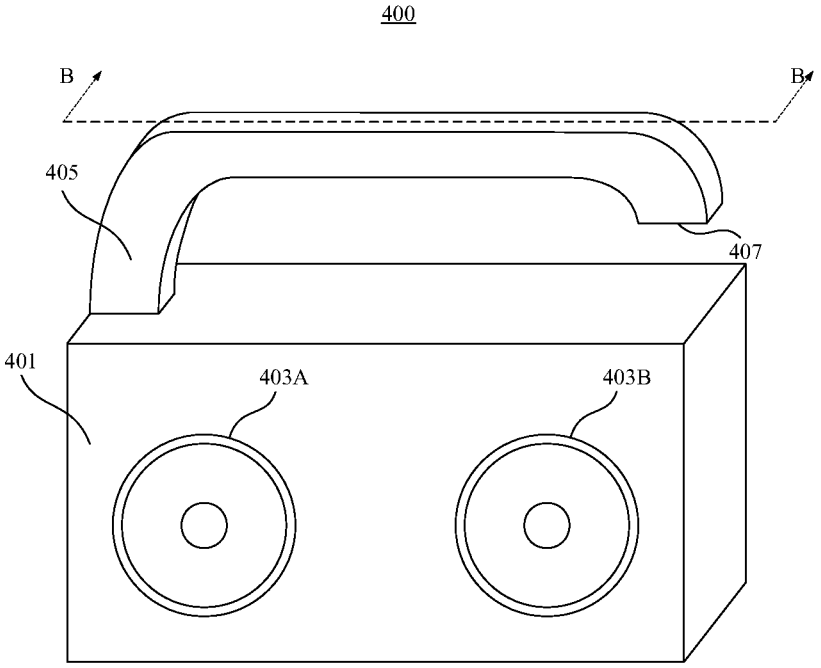
FIG. 5 schematically illustrates a three-dimensional view of a speaker 400 according to one embodiment of the present disclosure.
Figure 6:
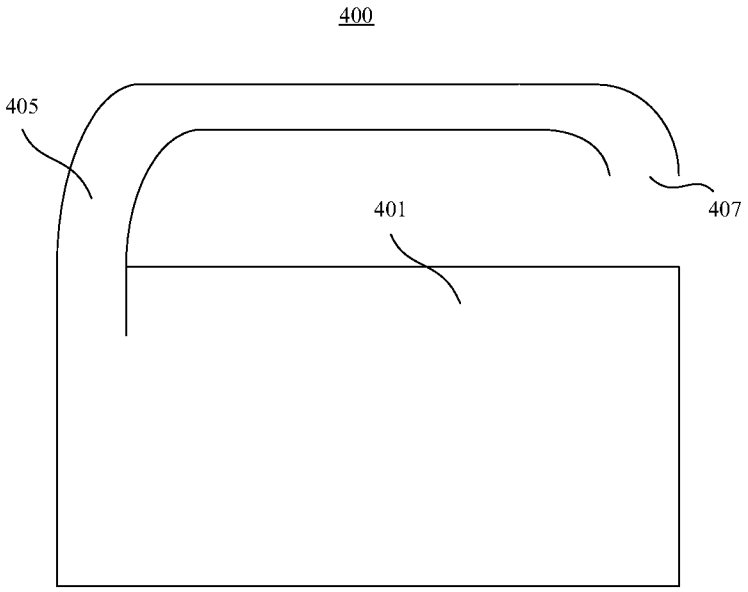
FIG. 6 schematically illustrates a cross-sectional view of the speaker 400 along BB direction shown in FIG. 5.

FIG. 5 schematically illustrates a three-dimensional view of a speaker 400 according to one embodiment of the present disclosure. FIG. 6 schematically illustrates a cross-sectional view of the speaker 400 along BB direction shown in FIG. 5. As shown in FIGS. 5 and 6, the speaker 400 may include a speaker box 401, two speaker drivers 403A and 403B, and a bass tube 405. Sound waves in the speaker box 401 may be guided out by the bass tube 405 through an opening 407. Detail information of the speaker box, the speaker drivers and the bass tube may be obtained by referring to above descriptions about the speaker 200 and will not be illustrated here.

An external part of the bass tube 405 which is outside the speaker box 401 forms a handle of the speaker 400. Therefore, the speaker 400 may be conveniently lifted with one hand, or hung on a hook, a stick or the like.

Specifically, in some embodiments, as shown in FIGS. 5 and 6, the external part may extend upward from a top surface of the speaker box 301, and then bend toward a substantially horizontal direction. The handle may be vertically projected onto the speaker box 301. In some embodiments, a vertical axis going through a barycentre of the speaker 300 substantially goes through the handle. Therefore, by applying an upward force on the handle, the speaker 400 can be hung or lifted.

The handle may have other configurations, as long as it can function as a handle. For example, in some embodiments, the external part may extend from other surface of the speaker box 301. In some embodiments, the external part may extend upward and then bend to have a shape like a hook.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

I claim:

1. A speaker, comprising:

a speaker box which defines an inner chamber; and a bass tube extending outward from the inner chamber, where an external part of the bass tube which is outside the speaker box forms a supporting structure of the speaker, where the external part of the bass tube includes an opening formed at an outer end thereof, and where a plate serves as a sidewall of the opening of the external part of the bass tube.

2. The speaker according to claim 1, wherein the supporting structure is a speaker stand for supporting the speaker on a surface.

3. The speaker according to claim 2, wherein the external part is disposed under the speaker box.

4. The speaker according to claim 2, wherein the external part extends downward from the speaker box.

5. The speaker according to claim 1, wherein more than 50% of a length of the bass tube is disposed outside the speaker box.

6. The speaker according to claim 1, further comprising a speaker driver positioned within the speaker box that is configured to generate sound waves and wherein the bass tube is configured to guide rear radiation out of the speaker box in response to the speaker driver generating the sound waves.

7. A speaker comprising:

a speaker box defining an inner chamber; and a bass tube including an external part that extends outward from the inner chamber and that extends away from the speaker box, the bass tube forming a supporting structure for the speaker, where the external part of the bass tube includes an opening formed at an outer end thereof, and where a plate serves as a sidewall of the opening of the external part of the bass tube.

8. The speaker of claim 7 wherein the supporting structure is a speaker stand for supporting the speaker on a surface.

9. The speaker of claim 8 wherein the external part is disposed under the speaker box.

10. The speaker of claim 8 wherein the external part extends downward from the speaker box.

11. A speaker comprising:

a speaker box; and a bass tube extending outward from an inner chamber of the speaker box, where an external part of the bass tube extends outside of the speaker box to form a supporting structure of the speaker, where the external part of the bass tube includes an opening formed at an outer end thereof, and where a plate serves as a sidewall of the opening of the external part of the bass tube.

* * * * *